US006469456B2

(12) United States Patent
Huang

(10) Patent No.: US 6,469,456 B2
(45) Date of Patent: Oct. 22, 2002

(54) SPARKLE SUPPRESSION CIRCUIT TO PROTECT THE CONTACT TERMINALS OF OPERATION LIGHT BULBS

(75) Inventor: Cheng-Chuah Huang, Chi Lung (TW)

(73) Assignee: Mediline Enterprise Corporation, Tao Yuan Hsien (TW)

( * ) Notice: Subject to any disclaimer, the term of this patent is extended or adjusted under 35 U.S.C. 154(b) by 0 days.

(21) Appl. No.: 09/813,994

(22) Filed: Mar. 22, 2001

(65) Prior Publication Data

US 2002/0135325 A1 Sep. 26, 2002

(51) Int. Cl.[7] ..... G05F 1/00; F02M 57/06
(52) U.S. Cl. ..... 315/291; 313/118
(58) Field of Search ..... 315/387, 371, 315/411, 127, 209, 224, 291, 295; 313/318; 362/260

(56) References Cited

U.S. PATENT DOCUMENTS 5,295,036 A * 3/1994 Yagi et al. ..... 361/79
5,886,423 A * 3/1999 Gershen et al. ..... 301/36
6,118,186 A * 9/2000 Scott et al. ..... 290/40 B
6,215,255 B1 * 4/2001 Kim et al. ..... 315/291
6,259,217 B1 * 7/2001 Song ..... 315/387
6,296,636 B1 * 10/2001 Cheng et al. ..... 606/32
6,329,766 B1 * 12/2001 Liu et al. ..... 315/295

* cited by examiner

*Primary Examiner*—David Vu
*Assistant Examiner*—Minh D A
(74) *Attorney, Agent, or Firm*—Birch, Stewart, Kolasch & Birch, LLP

(57) ABSTRACT

A sparkle suppression circuit to protect the contact terminals of operation light bulbs contains at least a power supply, a driving circuit, a sensor circuit, and a control circuit. The power supply provides the power needed for the suppression circuit. The sensor circuit detects sensor signals of the operation light bulb and to output the sensor signals. The control circuit receives and processes the sensor signals and thereby generates a driving signal to a driving circuit so as to control the switch of the operation light bulb. When the control circuit detects abnormal sensor signals, it sends out a driving signal to turn off the switch of the operation light bulb, terminating the power output.

11 Claims, 2 Drawing Sheets

SPARKLE SUPPRESSION CIRCUIT TO PROTECT THE CONTACT TERMINALS OF OPERATION LIGHT BULBS

BACKGROUND OF THE INVENTION

1. Field of Invention

The present invention relates to a power supply circuit for operation light bulbs and, in particular, to a protection circuit that can prevent sparkles produced when replacing operation light bulbs from happening.

2. Related Art

Operation light bulbs are indispensable illumination devices in the medical system. They are elements easily been worn out but have to be looked after so as to make sure those in the operation rooms are useable. In practice, an operation light bulb usually contains a main light bulb and a spare light bulb to avoid the situation that the main light bulb goes off during an operation and prevents the continuation of the operation. The power supply circuit of the light bulb detects the operation of the main light bulb through a sensor unit and automatically switches the power to the spare light bulb or notifies a user to do the switching, thus maintaining the normal operation of the medical operation.

However, when replacing the operation light bulbs, there is still a current through the contact terminals of the operation light bulbs unless the power is turned off. Since the operation light bulbs normally have a power between 150W to 250W, the actual current through the contact terminals is at least 6A to 10A. The possible sparkles occurring at the contact terminals during the replacement of the operation light bulbs may result in oxidization of the contact terminals, thus lowering the conduction rate of the contact terminals, or even induce explosion in the operation room, risking the patients and the medical crew. Therefore, it is a highly concerned subject to provide a protection circuit that can prevent sparkles produced while replacing the operation light bulbs.

SUMMARY OF THE INVENTION

It is a primary object of the invention to provide a protection circuit to avoid sparkles produced when replacing operation light bulbs so as to elongate the lifetime: of the contact terminals of operation light bulbs. The circuit includes a control circuit and a sensor circuit. The control circuit is mainly composed of a microprocessor having the functions of providing a user operation interface, indicating the system's state, generating a driving signal and processing signal detection. The sensor circuit uses different circuits according to different driving methods to achieve necessary controls. The sensor circuit can use such methods as pulse edge detection, voltage drop, or current detection.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
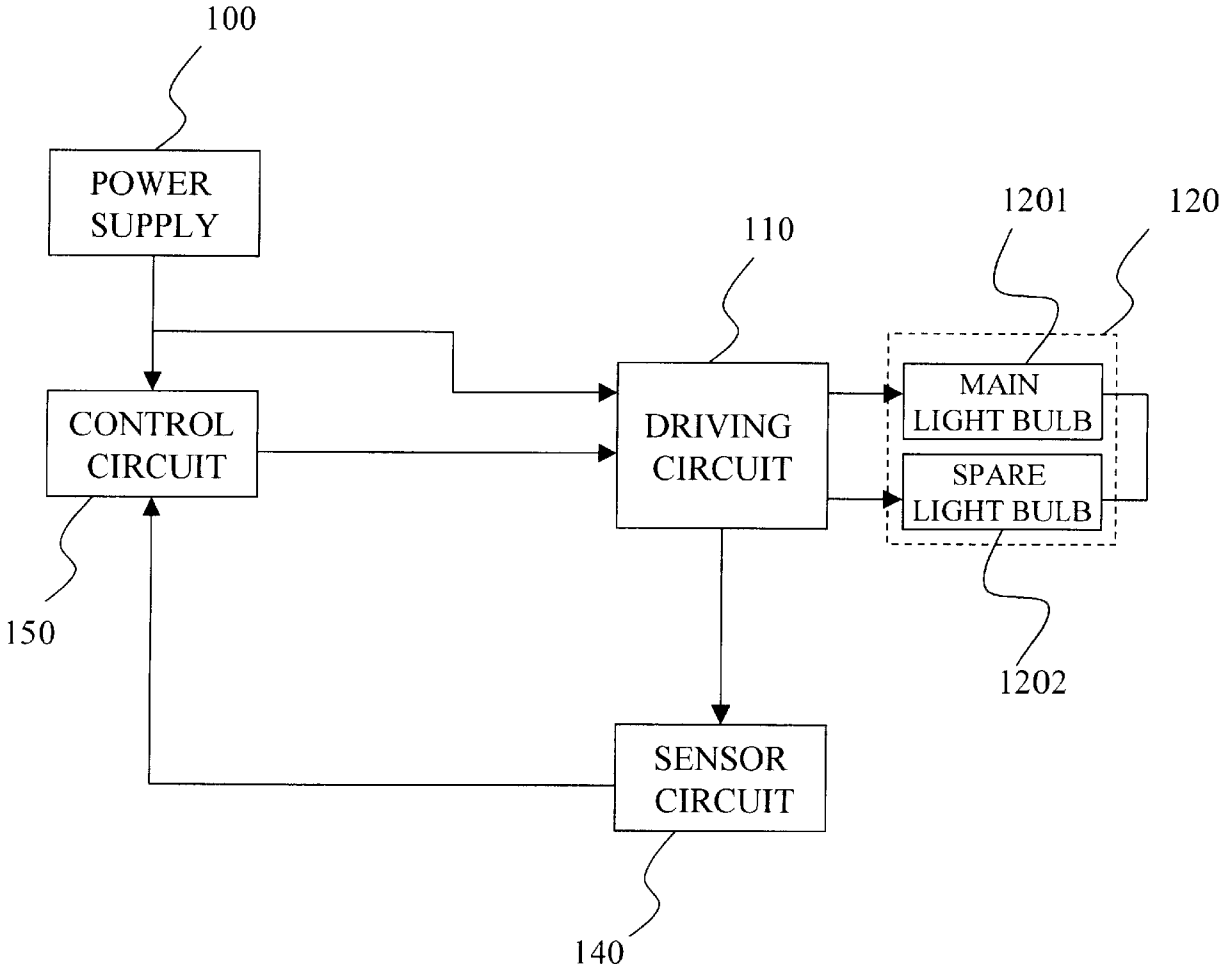
FIG. 1 shows a sparkle suppression circuit for protecting the contact terminals of operation light bulbs according to the present invention.

The present invention discloses a sparkle suppression circuit for protecting the contact terminals of operation light bulbs. The circuit contains a power supply 100, a driving circuit 110, an operation light bulb 120, a sensor circuit 140, a control circuit 150.

The driving circuit 110 drives the switch of a load loop (with the operation light bulb 120) or adjusts the power. It is mainly composed of a semiconductor controlled rectifier (SCR), a TRIAC, Relay or an MOSFET. The sensor circuit 140 uses different circuits according to different driving methods to achieve necessary controls. Preferred embodiments of the present invention are described hereinafter.

Figure 2:
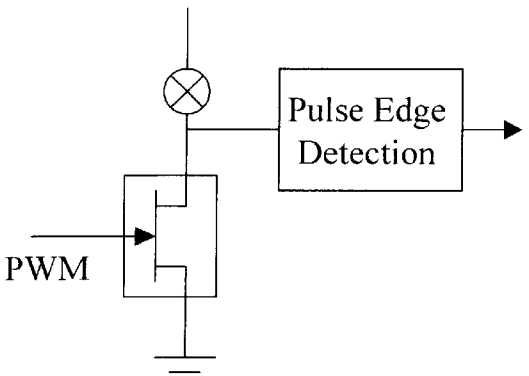
FIG. 2 shows a sensor circuit using the pulse width modulation method according to the invention.

With reference to FIG. 2, when the operation light bulb 120 is out of order, pulse edge detected output signals produced thereby will be different (the pulse width modulation output signal can be detected using pulse edge detection). At the moment, the signal is transmitted to the sensor circuit 140 through the switch. A control signal is sent out using the control circuit 150 to let the driving circuit 110 turn off the current for the operation light bulb 120. This means then removes charges on the contact terminals of the operation light bulb 120. Therefore, there will be no sparkles being produced at the contact terminals when replacing the operation light bulb 120.

Figure 3:
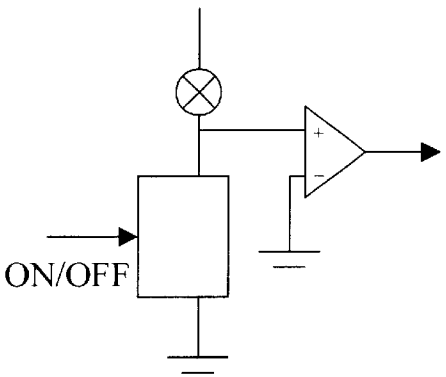
FIG. 3 shows a sensor circuit using the voltage drop method according to the invention.

With reference to FIG. 3, when the operation light bulb 120 is out of order, the voltage output signals produced thereby will be different (the voltage output signal can be detected using an operational amplifier). At the moment, the signal is transmitted to the sensor circuit 140 through the switch. A control signal is sent out using the control circuit 150 to let the driving circuit 110 turn off the current for the operation light bulb 120. This means then removes charges on the contact terminals of the operation light bulb 120. Therefore, there will be no sparkles being produced at the contact terminals when replacing the operation light bulb 120.

Figure 4:
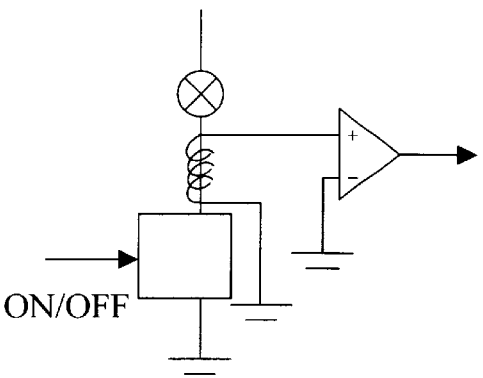
FIG. 4 shows a sensor circuit using the current detection method according to the invention.

With reference to FIG. 4, when the operation light bulb 120 is out of order, the current output signals produced thereby will be different (the current output signal can be detected using an inductor and an operational amplifier). At the moment, the signal is transmitted to the sensor circuit 140 through the switch. A control signal is sent out using the control circuit 150 to let the driving circuit 110 turn off the current for the operation light bulb 120. This means then removes charges on the contact terminals of the operation light bulb 120. Therefore, there Will be no sparkles being produced at the contact terminals when replacing the operation light bulb 120.

The control circuit 150 mainly consists of a microprocessor. Through proper designs, the microprocessor has a user operation interface. When the power supply 100 provides power to the control circuit 150, the control circuit 150 sends out a signal to the driving circuit 110. When the driving circuit 110 shuts down the current for the operation light bulb 120 and a new operation light bulb 120 is put on, the new operation light bulb 120 can be turned on through the sensor circuit 140. Furthermore, the control circuit 150 further contains a system state indicator to indicate the illumination state of the operation light bulb 120. Therefore, the control circuit 150 has the function of generating driving signals and processing sensor signals to prevent sparkles produced when replacing operation light bulbs.

In practice, the operation light bulb usually contains a main light bulb 1201 and a spare light bulb 1202 so as to avoid illumination failure of the main light bulb 1202 during an operation. For example, if the main light bulb 1201 burns out, the sensor circuit automatically switches the power supply to the spare light bulb 1202 to maintain normal illumination during the operation. Using the disclosed sparkle suppression circuit, the operation light bulb 120 can be turned on only through the switch of the sensor circuit 140 so as to make sure no sparkle is produced when replacing a bad light bulb.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A sparkle suppression circuit for protecting contact terminals of operation light bulbs, which comprises:

a power supply to provide power for the suppression circuit;

a driving circuit to drive a switch of a load loop;

a sensor circuit to detect sensor signals of the load loop and to output the sensor signals;

a control circuit including a microprocessor for receiving and processing the sensor signals and generating and transmitting a driving signal to the driving circuit to control the switch of the load loop; and wherein when the control circuit detects abnormal sensor signals, indicating that the load loop is not functioning correctly, the driving signal is sent out to shut off the switch of the load loop, terminating the power output, the load being the operation light bulb.

2. The circuit of claim 1, wherein the driving circuit can further adjust power.

3. The circuit of claim 1, wherein the driving circuit is a semiconductor controlled rectifier (SCR).

4. The circuit of claim 1, wherein the driving circuit is a TRIAC.

5. The circuit of claim 1, wherein the driving circuit is a Relay.

6. The circuit of claim 1, wherein the driving circuit is an MOSFET.

7. The circuit of claim 1, wherein the sensor circuit uses the pulse width modulation method for detection.

8. The circuit of claim 1, wherein the sensor circuit uses the voltage drop method for detection.

9. The circuit of claim 1, wherein the sensor circuit uses the current detection method for detection.

10. The circuit of claim 1, wherein the control circuit further contains a system state indicator to indicate the illumination state of the operation light bulb.

11. The circuit of claim 1, further comprising a switch to transmit the sensor signals to the sensor circuit.

* * * * *